US006742234B2

(12) United States Patent
Rosasco et al.

(10) Patent No.: US 6,742,234 B2
(45) Date of Patent: Jun. 1, 2004

(54) METHOD OF ROLLFORMING WITH TRANSVERSE SCORER AND DIMPLER

(75) Inventors: James J. Rosasco, Grand Haven, MI (US); Douglas L. Witte, Grand Haven, MI (US); Peter Sturrus, Ludington, MI (US)

(73) Assignee: Shape Corporation, Grand Haven, MI (US)

( * ) Notice: Subject to any disclaimer, the term of this patent is extended or adjusted under 35 U.S.C. 154(b) by 481 days.

(21) Appl. No.: 09/933,354

(22) Filed: Aug. 20, 2001

(65) Prior Publication Data

US 2002/0000031 A1 Jan. 3, 2002

Related U.S. Application Data

(62) Division of application No. 09/457,550, filed on Dec. 9, 1999, now Pat. No. 6,345,425.

(51) Int. Cl.[7] ..... B23P 17/00

(52) U.S. Cl. ..... 29/413; 29/417; 29/33 D; 29/464

(58) Field of Search ..... 29/413, 417, 33 D, 29/890.053, 33 T, 33 Q, 412, 414, 791, 819; 72/176, 13.5; 219/64, 66; 228/13, 18; 83/861, 862, 863, 864, 879, 880, 881, 883, 884, 865; 225/2, 94, 96, 96.5

(56) References Cited

U.S. PATENT DOCUMENTS

| | | | | | |
|---|---|---|---|---|---|
| 2,098,989 | A | | 11/1937 | Yoder | |
| 2,127,618 | A | | 8/1938 | Riemenschneider | |
| 2,158,400 | A | | 5/1939 | Chamberlin | |
| 2,222,842 | A | | 11/1940 | Humphrey | |
| 2,444,463 | A | | 7/1948 | Nordquist | |
| 2,444,465 | A | * | 7/1948 | Peters | 29/413 |
| 2,741,023 | A | | 4/1956 | Rafter | |
| 2,766,516 | A | | 10/1956 | Chantler | |
| 2,781,816 | A | | 2/1957 | Lawson | |
| 2,862,292 | A | | 12/1958 | Lawson | |
| 3,052,975 | A | | 9/1962 | Walters et al. | |
| 3,072,770 | A | | 1/1963 | Goodridge | |
| 3,124,872 | A | | 3/1964 | Knodel Jr. | |
| 3,165,815 | A | | 1/1965 | Wogerbauer | |
| 3,233,443 | A | | 2/1966 | Lawson | |
| 3,236,083 | A | | 2/1966 | Linderoth, Jr. et al. | |
| 3,285,212 | A | | 11/1966 | Obidowski | |
| 3,337,944 | A | * | 8/1967 | Morris | 29/413 |
| 3,338,554 | A | | 8/1967 | Gostomski | |
| 3,344,641 | A | | 10/1967 | Pomory | |
| 3,441,704 | A | * | 4/1969 | Worden et al. | 29/413 |
| 3,524,246 | A | | 8/1970 | Hudson et al. | |
| 3,595,527 | A | | 7/1971 | Douglass | |
| 3,638,465 | A | * | 2/1972 | Lickliter et al. | 72/181 |
| 3,689,970 | A | * | 9/1972 | Falkner | 29/897.312 |
| 3,738,613 | A | | 6/1973 | Hollis, Jr. | |

(List continued on next page.)

*Primary Examiner*—Irene Cuda Rosenbaum
*Assistant Examiner*—Marc Jimenez
(74) *Attorney, Agent, or Firm*—Price Heneveld Cooper DeWitt & Litton

(57) ABSTRACT

A method includes providing an apparatus that includes a scoring device for making transverse score lines on a roll of sheet material, a dimpler device or dimpler roller for making dimples adjacent the score lines at predetermined width locations, and a rollformer adapted to continuously form the sheet material into a tubular shape with channels. A welder is positioned in line with the rollformer and is adapted to weld the tubular shape into a permanent tube. A break off device positioned in line with the rollformer is adapted to break off sections of the tube at the score lines as the permanent tube exits the rollformer. The dimpler device is adapted to form an "in" dimple and an "out" dimple at locations coordinated with the score lines and with a width of the sheet material so that the "out" dimple forms a stop configured to slip into a channel formed in the sheet material by the rollformer but that abuts the "in" dimple which is formed at an end of the channel.

18 Claims, 5 Drawing Sheets

U.S. PATENT DOCUMENTS 3,764,109 A 10/1973 Hollis, Jr.
3,777,530 A 12/1973 Jansson
3,902,552 A 9/1975 McLain
3,918,626 A 11/1975 McLain
3,921,883 A 11/1975 McLain
4,025,749 A 5/1977 Spurr et al.
4,109,500 A 8/1978 Franek
4,142,663 A 3/1979 Blatnik et al.
4,189,821 A 2/1980 Potter
4,434,638 A 3/1984 Sivachenko
4,487,539 A * 12/1984 Taylor et al. ..... 413/55
4,585,059 A * 4/1986 Lee ..... 165/154
4,593,550 A 6/1986 Byrd
4,621,511 A 11/1986 Knudson
4,660,754 A 4/1987 Byrd
4,941,402 A 7/1990 D'Alterio
5,123,629 A 6/1992 Takeuchi
5,201,117 A * 4/1993 Wright ..... 29/413
5,375,654 A * 12/1994 Hougland et al. ..... 165/109.1
5,454,504 A 10/1995 Sturrus
5,829,666 A 11/1998 Takeda et al.
6,061,905 A 5/2000 Logic

* cited by examiner

METHOD OF ROLLFORMING WITH TRANSVERSE SCORER AND DIMPLER

CROSS REFERENCE TO RELATED APPLICATION

This application is a divisional of Appln. Ser. No. 09/457,550, filed Dec. 9, 1999 now U.S. Pat. No. 6,345,425, entitled ROLLFORMER WITH TRANSVERSE SCORER.

BACKGROUND OF THE INVENTION

The present invention relates to methods of manufacturing structural tubes where the tubes are adapted to telescopingly engage, and more particularly relates to rollforming tube sections with stops and stop-receiving guide channels, using break-off methods that facilitate separation of the tube sections at an end of the rollformer.

There exists a prior art car jack (for lifting a vehicle to change tires) that uses, as part of its assembly for vertical strength, three telescoping tube sections that telescopingly mate together. The three tube sections are configured to longitudinally slide between a collapsed position where all three tube sections lie within each other, and an extended position where all three tube sections extend from each other (with only an inch or so of each tube section overlapping with the next tube section). The arrangement also permits the three tube sections to telescopingly slide together during assembly of the jack. The inner one of the three tube sections includes a first "out" dimple. The intermediate one of the three tube sections includes a first channel for receiving the first "out" dimple and also includes a second "out" dimple. The outer one of the three tube sections includes a second channel for receiving the second "out" dimple, and a third channel for receiving the first channel. A first "in" dimple is formed at an end of the first channel and is configured to abut the first "out" dimple to limit telescoping movement of the inner and intermediate tube sections. A second "in" dimple is formed at an end of the second channel and is configured to abut the second "out" dimple to limit telescoping movement of the intermediate and outer tube sections.

The above-described three tube sections are made by tube-forming techniques, where a tube section is initially cut to length and then stamped/re-formed to include the various "in" dimples, "out" dimples, and channels or keyways. However, the tube-forming technique is relatively costly for many reasons. It requires considerable multiple forming steps which result in considerable handling, tooling, and machinery. This in turn results in high labor and processing costs, high overhead, and high in-process inventory, all of which are expensive. Further, there can be considerable variation in the manufactured tube sections, particularly over time as dies wear, which can be problematic because the jack requires that the tube sections maintain tight tolerances that permit smooth telescoping movement without sloppiness or binding. For example, if one tube section has a diameter that is non-round or oversized, the mating tube section will either bind and not telescope, or it will be sloppy and unable to maintain a linear telescoping action such that it will buckle. Also, for example, if a dimple or channel is not properly formed, the dimples will not properly engage to limit telescoping movement, which will result in the jack potentially coming apart, resulting in an upset vehicle owner and/or potential safety hazard.

Methods of manufacturing tube sections are desired that solve the aforementioned disadvantages and that offer the aforementioned advantages, where the methods are capable of providing tube sections shaped for telescoping mating use, and are capable of producing the same at high volume, low labor, low cost, and with high dimensional accuracy.

SUMMARY OF THE PRESENT INVENTION

In one aspect of the present invention, a method of manufacturing a structural tube comprises steps of providing a roll of sheet material, making transverse scoring lines in the sheet material, and rollforming a tubular shape from the sheet of material including forming a first longitudinal channel in the tubular shape. The method also comprises steps of welding the tubular shape into a permanent tube and breaking off tube sections of the permanent tube at the scoring lines and in line with an end of the rollformer.

In another aspect of the present invention, a method of manufacturing a structural tube comprises steps of providing a roll of sheet material, making transverse score lines in the sheet material and forming dimples in the sheet material. The method also comprises steps of rollforming a tubular shape from the sheet of material and forming a channel in the tubular shape.

In another aspect of the present invention, a method comprises steps of providing sheet material having a length and width, making non-uniformly deep transverse score lines on the sheet material and welding the tubular shape into a permanent tube. The method also includes steps of forming dimples adjacent the scoring lines with top and bottom dimpler rollers having top and bottom punches, the top and bottom punches being configured to form up and down dimples in the sheet material, and breaking off sections of the tube at the score lines.

In yet another aspect of the present invention, a method includes steps of providing sheet material having a length and width, making non-uniformly deep transverse score lines in the sheet material with a scoring roller, and rollforming the sheet material into a tubular shape. The method also includes steps of welding the tubular shape into a permanent tube, forming dimples adjacent the scoring lines with dimpler rollers having pre-scoring-line punches and post-scoring-line punches adapted to form dimples ahead of and after each scoring line, and breaking off sections of the tube at the score lines.

In still another aspect of the present invention, a method includes steps of providing sheet material having a length and width, and making transverse score lines on the sheet material. The method also includes steps of forming dimples with punches offset longitudinally forwardly and rearwardly from a position where the scoring lines pass under the punches, the punches being configured to form dimples in the sheet material at locations spaced longitudinally from the score lines, and continuously rollforming the sheet material into a tubular shape with a rollformer.

In still another aspect of the present invention, a method comprises steps of making transverse score lines on a roll of sheet material, forming dimples in the sheet material with punches at locations offset from a centerline of the sheet material and continuously forming the sheet material into a tubular shape. The method also comprises steps of welding the tubular shape into a permanent tube and breaking off sections of the tube at the score lines.

These and other aspects, features, and objects of the present invention will be further understood by reference to the following specification, claims, and appended drawings.

DETAILED DESCRIPTION OF PREFERRED EMBODIMENT

Figure 1:
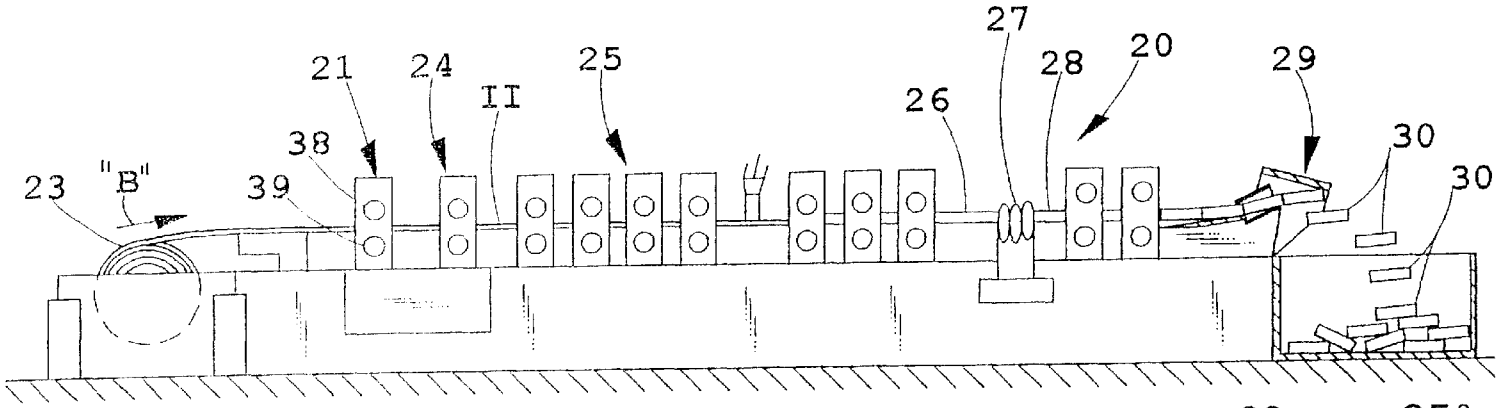
FIG. 1 is a side view of an apparatus embodying the present invention.

An apparatus 20 (FIG. 1) includes a scoring device 21 for making transverse score lines 22 (FIG. 2) on a roll of sheet material 23, a dimpler or punching device 24 for making dimples 31 and 32 adjacent the score lines 22 at a predetermined width location, and a rollformer 25 adapted to continuously form the sheet material 23 into a tubular shape 26. A welder 27 is positioned in line with and integrated into the rollformer 25 and is adapted to weld the tubular shape into a permanent tube 28. A break off device 29 positioned in line with and at an end of the rollformer 25 is adapted to break off tube sections 30 of the permanent tube 28 at the score lines 22 as the permanent tube 28 exits the rollformer 25 at high speed. The dimpler 24 is adapted to form an "in" dimple 31 and an "out" dimple 32 at locations coordinated with the score lines 22 and with a width of the sheet material so that the "out" dimple 32 forms one part of a stop on each tube section 30 and the "out" dimple forms one part of another stop on the tube section 30. The rollformer 25 forms one or more channels 33 (or 34 or 35) (FIG. 4) on each tube section, as discussed below. By the above apparatus and related method, tube sections having different diameters and different features can be made on different rollforming lines with the tube sections being configured to telescope together.

Figure 2:
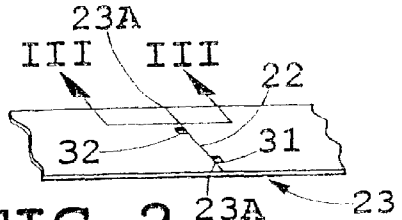
FIG. 2 is a fragmentary perspective view of the sheet at location II in FIG. 1.
Figure 3A:
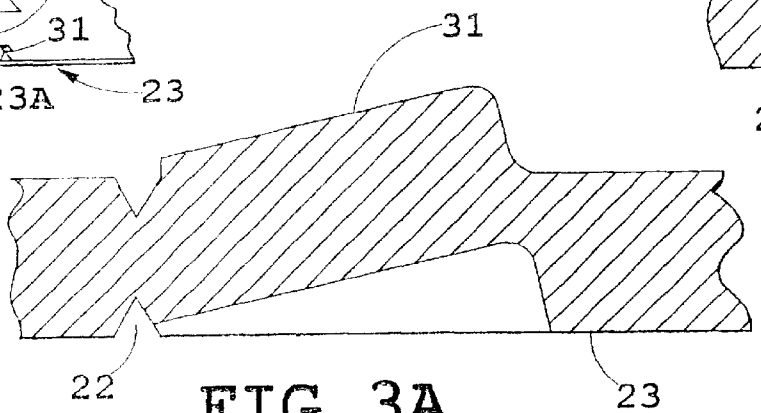
FIG. 3A is a cross section taken parallel line III—III but through a dimple roll-formed in the strip of FIG. 2.
Figure 4:
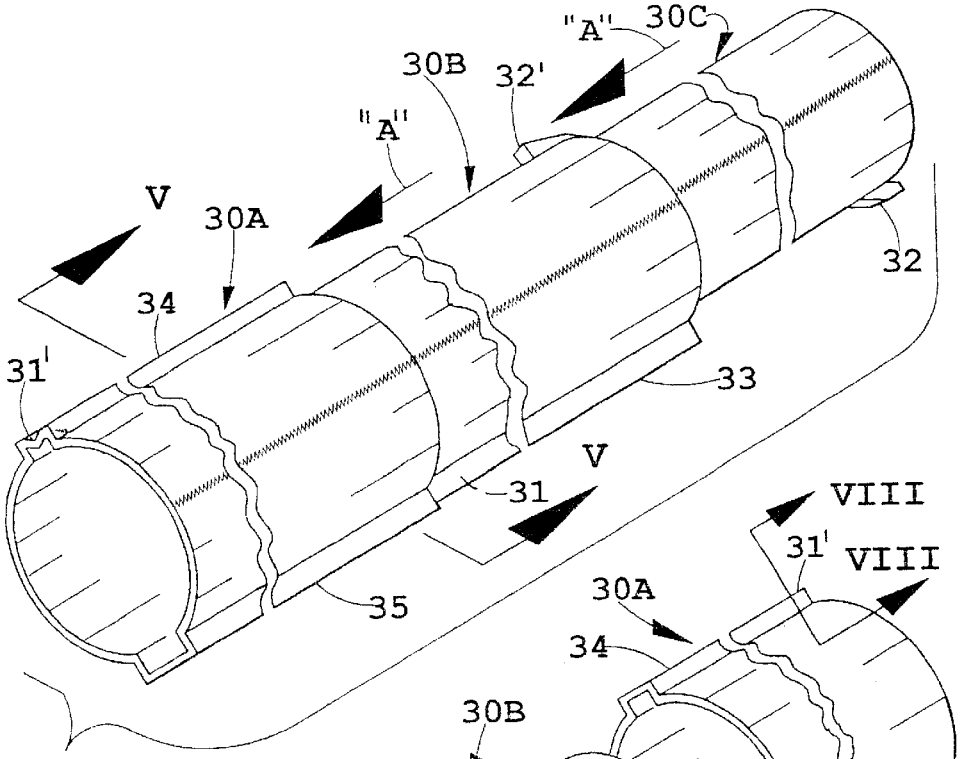
FIG. 4 is an exploded fragmentary bottom perspective view of a three-piece tubular assembly used in a car jack, the three-piece tubular assembly being exploded apart and positioned in line for assembly, the three pieces being configured to telescope together to a compact storage position where each inner tube is inside the adjacent outer tube, and to telescope further to an extended position where each tube extends several inches out of the next, each piece potentially being made from the apparatus of FIG. 1.
Figures 5, 6:
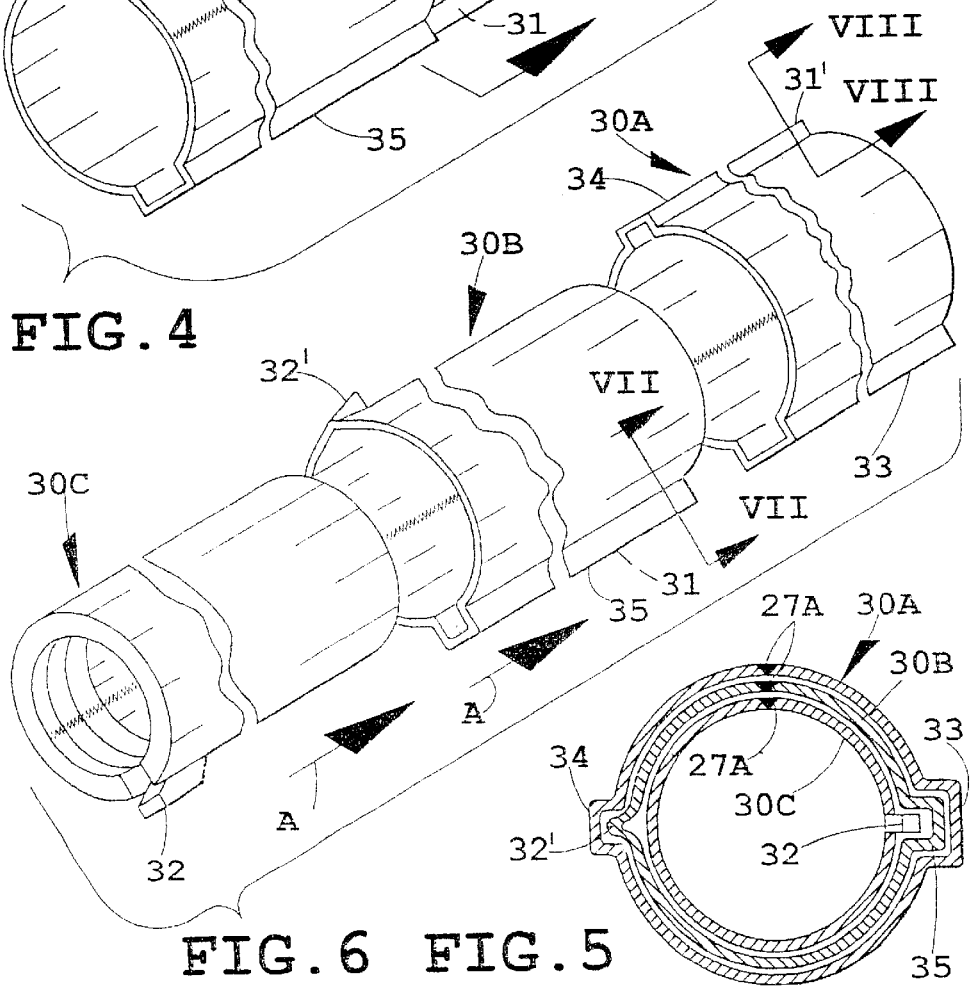
FIG. 5 is a cross section taken along line V—V in FIG. 4.
FIG. 6 is an exploded fragmentary top perspective view of the three-piece tubular assembly shown in FIG. 4.
Figure 4A:
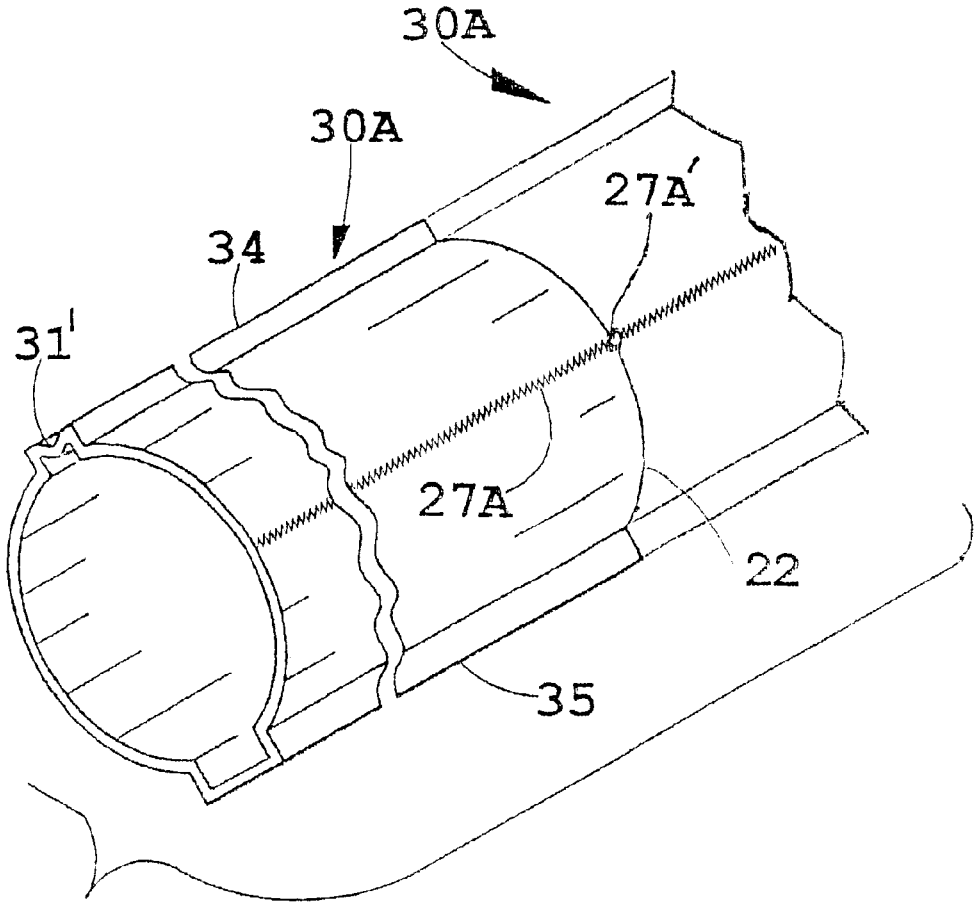
Figure 7:
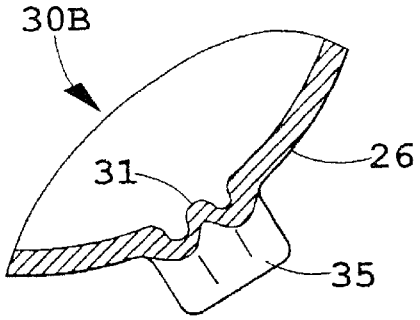
FIG. 7 is a cross section taken along line VII—VII in FIG. 6.
Figure 8:
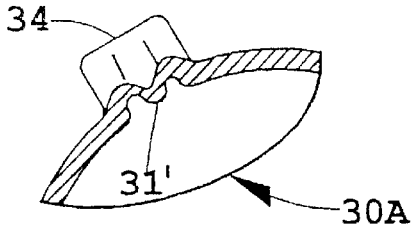
FIG. 8 is a cross section taken along line VIII—VIII in FIG. 6.

To facilitate the present description, the tube sections in FIG. 1 are referred to as tube section 30, while the three different tube sections illustrated in FIGS. 4–6 are referred to as tube sections 30A, 30B, and 30C. It is to be understood that the tube section 30 manufactured by the apparatus 20 can be any of the tube sections 30A, 30B, and 30C or reasonable variations thereof, as described below. In a preferred form, if the apparatus 20 is set up to run tube sections 30A, then only tube sections 30A can be run on that machine until the apparatus 20 is shut down and modified to run the other tube section 30B or the other tube section 30C. Naturally, multiple apparatus 20 can be run side by side to make the tubes (30A, 30B, and 30C) as needed. The rollforming apparatus 20 is operable at high speed and produces high quality and dimensionally accurate parts that are separated and that are substantially complete as the parts come off the rollform apparatus 20. It is contemplated that the present arrangement saves considerable costs, including reduced labor, reduced tooling costs, reduced machine time, and a substantial reduction of in-process inventories.

The present tube sections 30A, 30B and 30C are described below in sufficient detail to provide an understanding of the present invention. The illustrated tube sections 30A, 30B and 30C (FIGS. 4 and 6) are adapted to telescope together to form an extendable shield or jack screw housing of a car jack (used for lifting a vehicle to change a tire). The car jack uses, as part of its assembly for strength, stability and safety around the area of the jack screw, three extendable tube sections that telescopingly mate together between a collapsed position where all three tube sections 30A, 30B, and 30C are within each other, and an extended position where all three tube sections 30A, 30B and 30C are extended with only a short section overlapping. The illustrated tube sections 30A, 30B and 30C are shaped to replace the prior art tube sections in the prior art car jack. It is not believed to be important to describe the prior art car jack assembly in detail, since the present invention primarily concerns an apparatus and method for manufacturing tube sections, and the resulting product by process, and does not concern the jack assembly per se. The process for forming the prior art tube sections, to the extent known, is described in the background section of the present description. It is not believed to be important to describe the process for forming the prior art tube sections in detail since the present invention primarily concerns an apparatus and method that incorporates rollforming. Further, the specific tube forming techniques and stamping techniques used in the prior art tube sections are not known in detail. To the extent a person may be interested in tube-forming techniques and stamping techniques, it is noted that such techniques are generally well known in the art and are believed to be publicly available and in the public domain.

The three illustrated tube sections 30A, 30B and 30C (FIGS. 4 and 6) are configured to longitudinally slide together for assembly in direction "A" and thereafter be moveable between a collapsed position where all three tube sections 30A, 30B and 30C lie within each other, and an extended position where all three tube sections 30A, 30B and 30C extend from each other (with only part of an inch or so of each tube section overlapping with the next tube section). The inner tube section 30C of the three tube sections includes a first "out" dimple 32. The intermediate tube section 30B includes a first channel 33 for receiving the first "out" dimple 32 and also includes a second "out" dimple 32' at 180 degrees from the first channel 33. The outer tube section 30A includes a second channel 34 for receiving the second "out" dimple 32', and a third channel 35 for receiving the first channel 33. A first "in" dimple 31 is formed at an end of the first channel 33 and is configured to abut the first "out" dimple 32 to limit telescoping movement of the inner and intermediate tube sections 30C and 30B. A second "in" dimple 31' is formed at an end of the second channel 34 and is configured to abut the second "out" dimple 32' to limit telescoping movement of the intermediate and outer tube sections 30A and 30B. The "in" dimples and "out" dimples form pairs of abutting stops that engage to limit extension of the respective tube sections to a maximum extended position. The width of the "out" dimples are sufficiently narrow to slide easily along the respective channels that receive them, but are sufficiently wide to prevent them from sliding past the mating "in" dimples in the associated channels.

The roll of sheet material 23 (FIG. 2) can be any thickness or type of material to provide sufficient structure for the characteristics required of the tube sections 30. The particular illustrated sheet material 23 is cold rolled steel such as CRS 1008 or CRS 1010 or similar cold (or hot) rolled steel or other metal. The sheet material 23 has a thickness of about 0.070–0.085 inch thickness. Notably, aluminum sheet having a thickness of 0.125 to 0.150 inches could also be used. The roll of sheet material 23 is fed in a direction "B" from an uncoiler, through the scoring device 21 and the synchronized dimpler device 24 along the rollformer 25 with welder 27 to break-off device 29.

Figure 3:
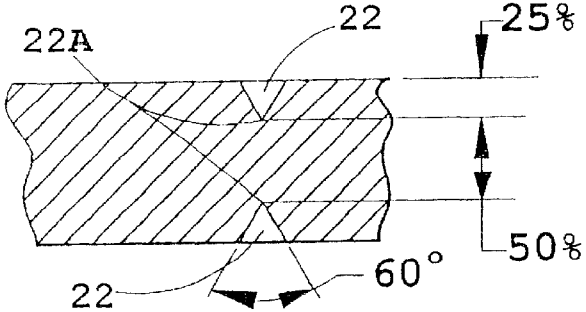
FIG. 3 is a cross section taken along line III—III in FIG. 2.

The scored line 22 (FIG. 3) is formed by upper and lower score blades, each having a "V" shape with a relatively sharp point 22A. The relatively sharp point 22A assists the break-off device 29 in breaking apart successive tube sections 30 from each other, as described below. It is noted that a relatively sharp point 22A assists in crack initiation, but that the point 22A need not be sharp per se. In fact, it is contemplated that the scoring die forming the sharp point 22A will wear at its tip slightly over time, such that the point 22A at its extremity will be slightly rounded, yet the break-off device 29 will function very well and satisfactorily. In the illustrated material, the score lines (referred to collectively as scoring line 22) are preferably each about 20% to 25% deep, such that the combined total depth of the score lines is about 40% to 50% of the thickness of the material. The "V" forms an included angle of about 60 degrees. It is noted that the score lines may have different preferred shaped, depths, sizes, and etc, depending upon the sheet material being formed.

Figure 11:
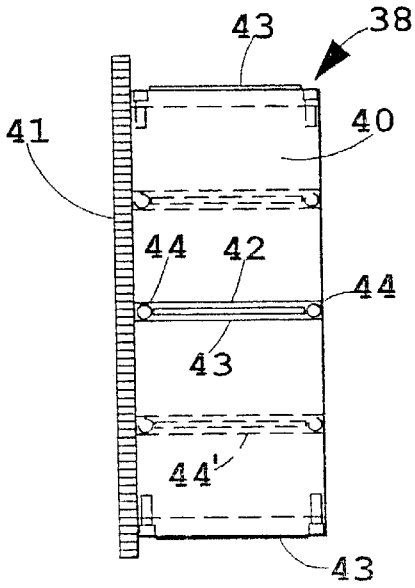
FIG. 11 is an enlarged view of one of the score rollers shown in FIG. 10.
Figure 9:
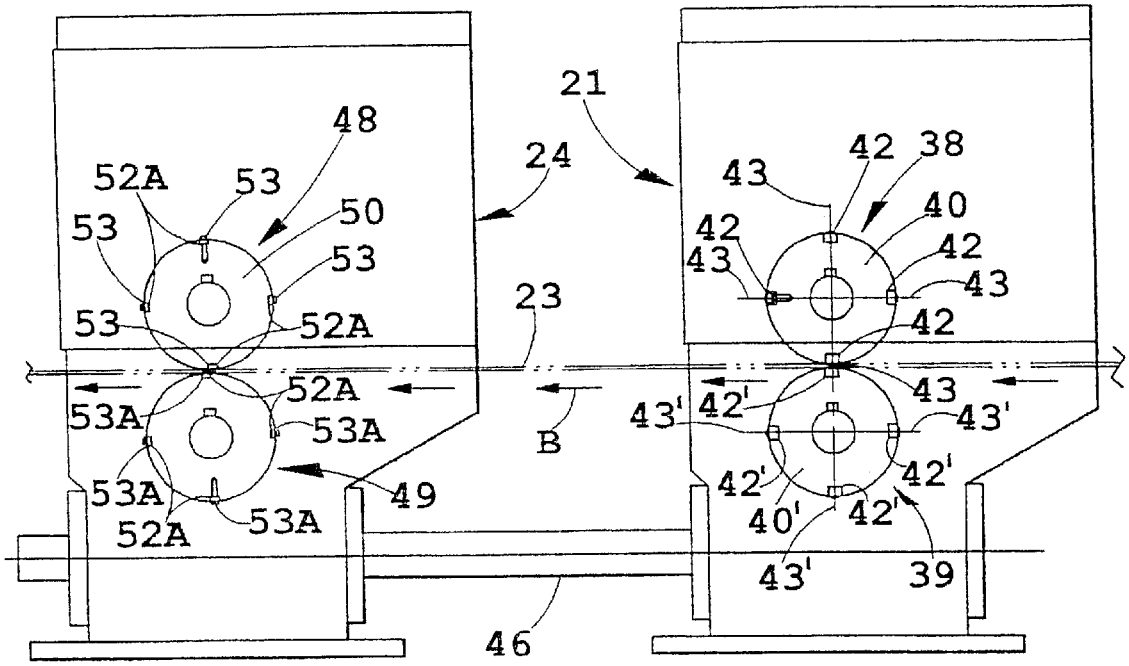
FIG. 9 is a side view of the scoring and punching roller stations on the apparatus of FIG. 1.

The scoring lines 22 are formed at a scoring station by the scoring device 21 (FIGS. 1 and 9) via a mating pair of scoring rollers 38 and 39. The top scoring roller 38 (FIG. 11) includes a roller body 40 having a gear 41 bolted to one side. The roller body 40 includes recesses 42 shaped to receive a scoring blade 43 that is secured in place with bolts 44. The illustrated roller body 40 has four recesses 42 equally spaced around the roller body 40. "Extra" blade recesses 44' (shown in dashed lines) may be provided for the purpose of selectively adding scoring blades 43. This allows blades 43 to be selectively secured to the scoring roller 38 at predetermined distances around the scoring roller 38. Optimally, the blades 43 are secured at equal distances apart so that each tube section produced has the same length as other tube sections and there is no waste. For example, where the distance around the scoring roller body 40 is 12 inches, four scoring blades 43 spaced 3 inches apart can be used to cut tube sections 30 that are each 3 inches long. Alternatively, if only half of the recesses 44 have scoring blades 43 attached, then the tube sections 30 are each 6 inches long. Alternatively, where the same roller body 40 (i.e. 12 inches around) has three scoring blades 43 spaced 4 inches apart, it forms tube sections 30 that are each 4 inches long.

The bottom scoring roller 39 (FIG. 9) is identical to the top scoring roller 38, with the exception that the gear attached to the scoring roller 39 has teeth offset slightly so that the scoring blades 43 of the top and bottom scoring rollers 38 and 39 are aligned with each other when their respective gears 41 are interengaged. Notably, it is contemplated that other means can be used to synchronize rotation of the top and bottom scoring rollers 38 and 39 other than gears 41. For example, a zero-backlash gearbox is known in the art. A zero-backlash gearbox, with the scoring rollers 38 and 39 keyed in position, can be used to operably interconnect the top and bottom scoring roller 38 and 39 and to operably connect the scoring rollers 38 and 39 to a drive shaft 46.

Figure 12:
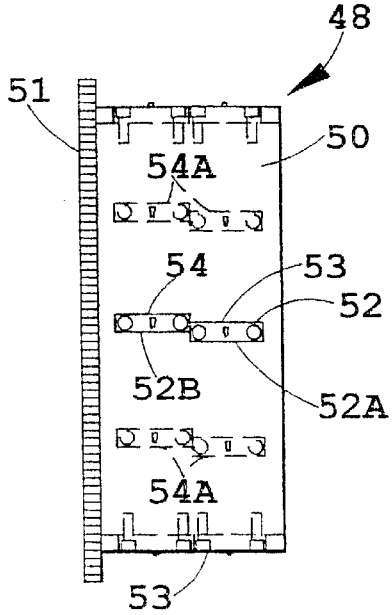
FIG. 12 is an enlarged view of one of the punch rollers shown in FIG. 10.
Figure 10:
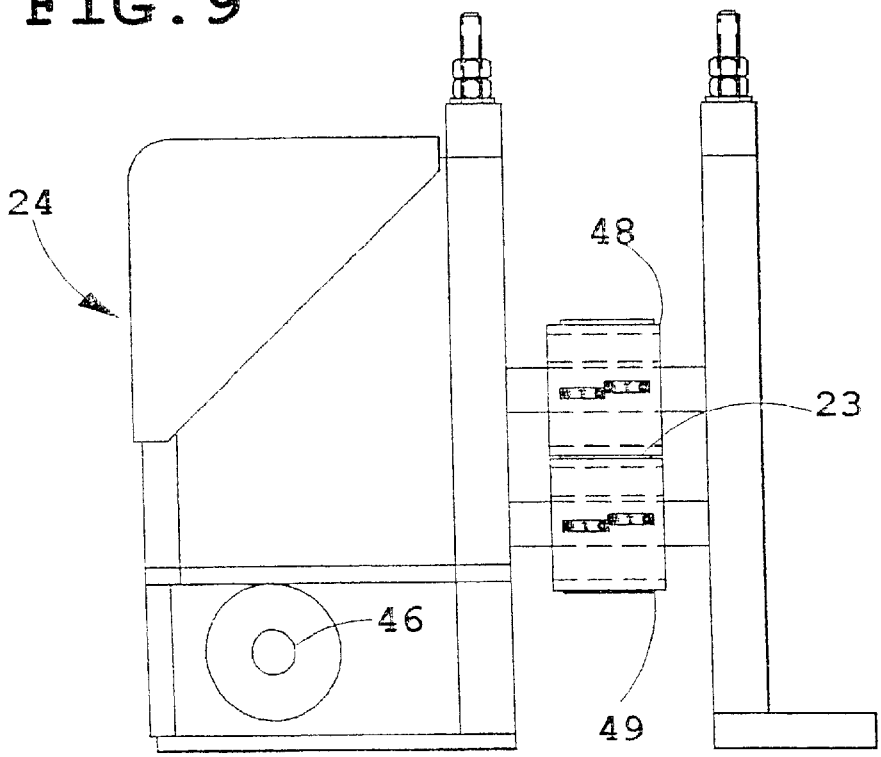
FIG. 10 is an end view of the scoring roller station on the apparatus of FIG. 1.

The dimpler 24 (FIGS. 9, 10 and 12) is located at a dimpler station or punch station, and includes top and bottom mating dimpler rollers 48 and 49 that are not unlike the scoring rollers 38 and 39. Specifically, the top dimpler roller 48 includes a roller body 50 having a gear 51 (FIG. 12) bolted to one side. The roller body 50 includes recesses 52 shaped to receive a die 52A having a dimpler punch 53 or female button 53A (FIG. 9) for matingly receiving a punch. The die 52A is secured in place with bolts 54. The illustrated roller body 50 (FIG. 12) has four pre-score-line recesses 52 and four post-score-line recesses 52B equally spaced around the roller body 50. "Extra" blade recesses 54A (shown in dashed lines) may be provided for the purpose of selectively adding dimpler punches 53 (or buttons 53A) as described below. This allows dimpler punches 53 or female buttons 53A to be selectively secured to the dimpler roller 48 at predetermined distances around the dimpler roller 48. Optimally, the punches 53 are secured at equal distances apart where they exactly match the scoring rollers 38. By this means, each tube section produced has the same length and the same dimples as other tube sections and there is no waste. For example, where the distance around the dimple roller body 50 is 12 inches, four pre-score-line dimpler punches 53 spaced 3 inches apart can be used to form dimples in tube sections 30 that are each 3 inches long. Alternatively, if only half of the recesses 54 have dimpler punches 53 attached, then the arrangement is useful for tube sections 30 that are each 6 inches long. It is noted that different spacing or lengths can be achieved by changing the diameter of the dimpler roller 48.

The bottom dimpler roller 49 (FIG. 9) has a roller body 50 that is identical to the top dimpler roller body 50, with the exception that the gear has teeth offset slightly so that the dimpler punches 53 (and/or bottoms 53A) of the top and bottom rollers 48 and 49 are aligned with each other when the gears 51 are interengaged. Notably, it is contemplated that other means can be used to synchronize rotation of the top and bottom dimpler rollers 48 and 49 other than gears 51. For example, a zero-backlash gearbox (known in the art) can be used to operably interconnect the top and bottom dimpler roller 48 and 49 and to operably connect the dimpler rollers 48 and 49 to the drive shaft 46. By using the same drive shaft 46, the dimpler station 47 and the scoring station 37 are always synchronized.

It is contemplated that a dimpler punch 53 can be secured in either or both of the recesses 52 and 52B in either one of the top and bottom dimpler rollers 48 and 49. Further, it is contemplated that a button 53A may be secured in the recess that corresponds to the selected recess 52 having a dimpler punch 53 to help form a sharper surface on the dimple (31 or 32). Punches 53 and buttons 53A are known in the art, and need not be described in detail for an understanding of the present invention. Basically, buttons 53A are female dies with recesses shaped to closely receive edges of a protruding portion of a dimpler punch 53. By this means, they assist in accurately forming and shaping dimples (31 and 32) formed by dimpler punches 53. When used, the button 53A is secured in one of the recesses 52 at a location corresponding to the punch 53 that it is to receive. It is noted that buttons may not be required in some circumstances. Some of the illustrated recesses 52 are located at pre-scoring-line locations, while others 52A are located at post-scoring-line locations. It is contemplated that these recesses could be enlarged to straddle the scoring lines 22. This would allow the recesses to receive dimpler punches having protruding portions that are located in one or both of the pre-score-line and post-score-line positions.

Preferably, the drive shaft 46 (FIG. 9) is connected to the drive shaft of the rollformer 25, such that operation of the rollformer 25 automatically operates the score and punch drive shaft 46. Alternatively, separate drive shafts and motors can be used.

The scoring rollers 38 and 39 are configured to mark the score line 22 across a width of the sheet material 23. The score line 22 may have a continuously uniform depth across the sheet material, but it does not have to have a uniform depth completely across the width. For example, it may be desirable to make a shallower score line 22 score line at all) near the edges 23A of the sheet material 23. A reason for a line 22 is so that when the material is welded, the welder 27 does not blow holes in the material at the score line 22, where the weld heat is focused by the score line 22. On the hand, some minor, weld blowing may in fact be desirable since it can help the break operation, particulary since the welded material has changed properties due to the weld depends largely on the material or thickness of the sheet, the welding parameters, a speed of the rollformer, and numerous other variables connected with the overall process. The optimal depth of the score line 22 at edges of the sheet material 23 appears to be a depth that is sufficiently shallow enough to reduce weld blowing to an acceptable amount, but that does cause some weld blowing to occur at weld blow hole 27A. Specifically, it is contemplated that a score line depth at the edges preferably should be about 10% to 20%, and/or perhaps be only marked on one side.

Welding of tubular steel is well known in the art. For example, welding of steel sheet rollformed into a tubular shape is disclosed in U.S. Pat. No. 5,454,504 to Sturrus. It is noted that many different types of welders are well known in the art and can be used for welder 27, including continuous and non-continuous welders (e.g. spot welders). Notably, it is contemplated that features of the present apparatus 20 may be useful even where welding is not used, or where another form of securement other than welding is used, such as overlapping of folded edge flanges or adhesive. In the present embodiment, a continuous weld bead 27A (FIG. 5) is made along the entire permanent tube 28. If desired, a void caused by a weld blowing could occur at extreme ends of the tubes (i.e. at the score lines). Such voids would not be detrimental, and may, in fact, help the break-off step.

Figure 13:
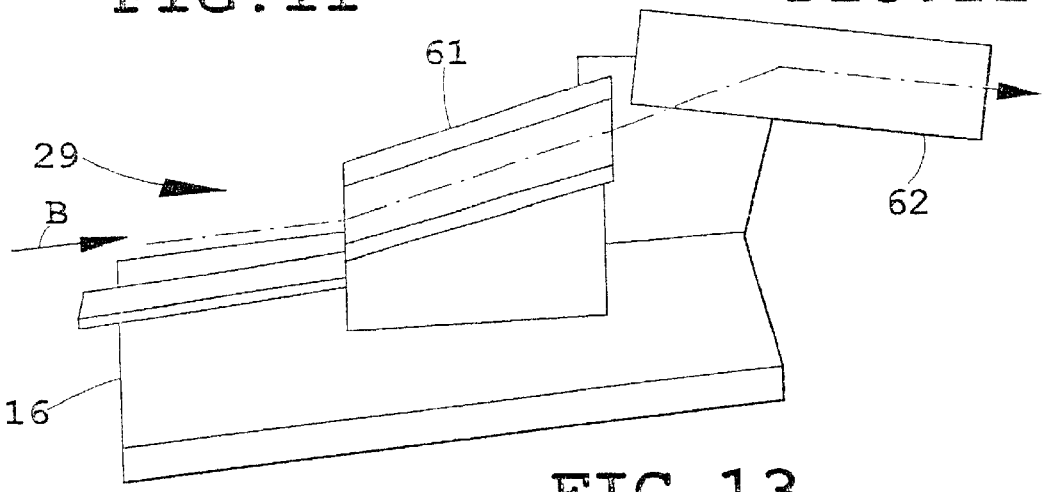
FIG. 13 is a perspective view of the break-off device shown in FIG. 1.

The break-off device 29 (FIG. 13) includes a base 60, an up deflector 61 and a down deflector 62. The permanent tube 28 enters the up deflector along a horizontal direction "B". The up deflector 61 includes opposing C-shaped halves bolted together to form a tubular hole that is slightly larger than but close in diameter to the scored permanent tube 28 coming off of the rollformer 25. The down deflector 62 is a C-shaped member that defines a path generally aligned with the tubular hole but that extends at a down angle. The up deflector 61 and down deflector 62 have a length that generally matches but is a little longer than a length of the tube section 30 being broken. The up and down deflectors 61 and 62 are generally aligned with the direction of travel "B" of the permanent tube 28 as it comes off the rollformer 25, but the up deflector 61 forces the tube 28 to bend up at about a 20 to 30 degree angle such that the permanent tube 28 breaks a first time, and then the down deflector 62 forces the tube to bend down at about a 20 to 30 degree angle such that the permanent tube 28 breaks into the tube sections 30. The up angle and down angle are chosen to be enough to positively and reliably break the permanent tube 28 at the score lines 22, thus forming the tube sections 30. It is contemplated that other breaking means can be used, such as an impact hammer or wedge, or hammer that cycles as each tube section 30 crosses over a break-point fulcrum if desired, but the present break-off device 29 is reliable, relatively quiet, passive, low maintenance, and very inexpensive. It is contemplated that the present break-off device 29 will function effectively for a wide variety of tube sizes, but it is believed to be particularly effective where tube sections 30 have a diameter range that is from about 1-½ inches up to about 3 inches, and that have a length range of about 4 to 8 inches long.

As apparent from reading the above, a preferred method of manufacturing a structural tube includes a method of manufacturing a structural tube comprising steps of providing a roll of sheet material; making transverse scoring lines in the sheet material; rollforming a tubular shape from the sheet of material including forming a first longitudinal channel in the tubular shape; welding the tubular shape into a permanent tube; and breaking off tube sections of the permanent tube at the scoring lines and in line with an end of the rollformer forming stop dimples in the tube.

It will be readily apparent to those skilled in the art that modifications and changes can be made from the disclosed preferred embodiment without departing from a scope of the present invention. Such modifications and variations are to be considered as included in the present invention, unless the claims by their language expressly require otherwise.

The invention claimed is:

1. A method of manufacturing a structural tube comprising steps of:

providing a roll of sheet material;

making transverse scoring lines in the sheet material;

rollforming a tubular shape from the sheet of material including forming a first longitudinal channel in the tubular shape, the channel having parallel sidewalls and an outer wall that is perpendicular to the sidewalls;

welding the tubular shape into a permanent tube; and breaking off tube sections of the permanent tube at the scoring lines and in line with an end of the rollformer.

2. The method defined in claim 1, including a step of rollforming a second permanent tube with a rectangularly shaped second longitudinal channel, the second permanent tube having a cross section shaped to matingly telescopingly engage a cross section of the first-mentioned permanent tube, and including a step of telescope engaging the first-mentioned and second permanent tubes including engaging the first and second longitudinal channels to prevent undesired relative rotation.

3. The method defined in claim 2, when the step of rollforming the second tube includes forming a first stop dimple along the second longitudinal channel is the second tube that is shaped to matingly slidingly engage a second stop dimple along the first longitudinal channel.

4. The method defined in claim 3, including forming the first stop dimple at an end of the first longitudinal channel during the step of rollforming the first longitudinal channel.

5. The method defined in claim 2, including a step of rollforming a third permanent tube, the third permanent tube having a cross section shaped to matingly telescopingly engage the cross section of the second permanent tube, such that the respective tube sections when broken off from each of the first-mentioned, second and third permanent tubes are configured and adapted to telescopingly engage, and including forming dimples in at least some of the respective tube sections, the dimples being shaped to engage ends of mating ones of the respective tube sections to limit their telescoping engagement.

6. The method defined in claim 2, wherein the step of rollforming the tubular shape includes forming the tubular shape from sheet metal that is at least about 0.070 inches thick.

7. The method defined in claim 1, wherein the welder forms a weld, and including forming the first longitudinal channel at about a 90-degree angle to the scoring lines.

8. The method defined in claim 1, wherein the welder forms an elongated weld bead, the weld forming a blown hole at each scoring line.

9. The method defined in claim 1, wherein the step of making transverse score lines in the sheet material includes making the transverse scoring lines non-uniform in depth.

10. The method defined in claim 9, wherein the scoring lines are wade shallower at side edges of the sheet material than in a middle area of the sheet material.

11. A method of manufacturing a structural tube comprising steps of:

providing a roll of sheet material;

making transverse score lines in the sheet material;

forming dimples in the sheet material;

rollforming a tubular shape from the sheet of material, forming a channel in the tubular shape with at least one of the dimples being located in the channel.

12. The method defined in claim 11, wherein the step of forming dimples includes forming the dimples in line with the rollformer with a dimple roller.

13. The method defined in claim 11, wherein the step of forming dimples includes forming a dimple in an outer wall of the channel.

14. The method defined in claim 11, wherein the step of making transverse score lines in the sheet material includes making the transverse scoring lines non-uniform in depth.

15. The method defined in claim 11, including welding the tubular shape to form a permanent tube, and wherein the channel is spaced from welded material of the permanent tube.

16. A method comprising steps of:

providing sheet material having a length and width;

making transverse score lines on the sheet material;

forming dimples with punches located so that the scoring lines pass under the punches, the punches being configured to form dimples in the sheet material with stop surfaces at locations spaced longitudinally from the score lines; and continuously rollforming the sheet material into a tubular shape with a rollformer, including forming a longitudinal channel with parallel sidewalls and a perpendicular outer wall on the tubular shape.

17. A method comprising steps of:

making transverse score lines on a roll of sheet material;

forming dimples in the sheet material with punches at locations offset from a centerline of the sheet material;

rollforming the sheet material including forming a longitudinal channel having orthogonal side and outer walls, and continuously forming the sheet material into a tubular shape;

welding the tubular shape into a permanent tube; and separating sections of the tube at the score lines.

18. A method of manufacturing a structural tube comprising steps of:

providing a roll of sheet material;

making transverse scoring lines in the sheet material;

rollforming a tubular shape from the sheet of material including forming a first longitudinal channel in the tubular shape, the channel having parallel sidewalls and an outer wall that is perpendicular to the sidewalls and further including to a stop dimple in a predetermined location relative to the channel; and welding the tubular shape into a permanent tube.

* * * * *

UNITED STATES PATENT AND TRADEMARK OFFICE

CERTIFICATE OF CORRECTION

PATENT NO. : 6,742,234 B2
DATED : June 1, 2004
INVENTOR(S) : James J. Rosasco et al.

It is certified that error appears in the above-identified patent and that said Letters Patent is hereby corrected as shown below:

Column 7,
Line 22, after "score line 22", insert -- (or no --;
Line 23, before "line 22", insert -- shallower score --;
Line 26, before "hand", insert -- other --;
Line 28, "break" should be -- break-off --;
Line 29, after "weld", insert -- heat. This --;

Column 8,
Line 56, "telescope" should be -- telescopingly --;
Line 60, "when" should be -- wherein --;

Column 9,
Line 26, "wade" should be -- made --;

Column 10,
Line 41, delete "to" and substitute therefore -- forming --.

Signed and Sealed this

Thirty-first Day of August, 2004

JON W. DUDAS
*Director of the United States Patent and Trademark Office*